United States Patent [19]

Dent et al.

[11] 4,276,856

[45] Jul. 7, 1981

[54] STEAM GENERATOR SLUDGE LANCING METHOD

[75] Inventors: Thomas H. Dent, Greensburg; Diane E. Jordan, Irwin; William E. King, McCandless Twp., Allegheny County; Frank W. Rieger, Penn Hills, all of Pa.

[73] Assignee: Westinghouse Electric Corp., Pittsburgh, Pa.

[21] Appl. No.: 974,177

[22] Filed: Dec. 28, 1978

[51] Int. Cl.[3] ..... F22B 37/52; F22B 37/54

[52] U.S. Cl. ..... 122/382; 122/390; 122/392; 122/405; 239/101; 239/245; 239/554; 15/316 R

[58] Field of Search ..... 122/381–384, 122/390, 392, 405, 512; 239/101, 243, 245, 450, 549, 554, 550; 15/316 R, 316 A, 104.04; 134/167 C, 172, 168 C, 198

[56] References Cited

U.S. PATENT DOCUMENTS

| | | | |
|---|---|---|---|
| 994,727 | 6/1911 | Dwyer et al. | 122/383 |
| 1,139,911 | 5/1915 | Shepler et al. | 15/316 R |
| 1,827,085 | 10/1931 | Huff | 122/379 |
| 2,613,737 | 10/1952 | Schwietert | 239/549 |
| 2,933,259 | 4/1960 | Raskin | 239/549 |
| 3,311,092 | 3/1967 | McMahon et al. | 122/392 |
| 3,924,805 | 12/1975 | Nebeker et al. | 239/101 |
| 4,079,701 | 3/1978 | Hickman et al. | 122/382 |
| 4,131,233 | 12/1978 | Koenig | 239/101 |

*Primary Examiner*—Henry C. Yuen

*Attorney, Agent, or Firm*—L. A. DePaul; Z. L. Dermer

[57] ABSTRACT

A method for removing sludge that may be deposited on a tubesheet of a steam generator comprises placement of fluid headers at the elevation of the sludge to be removed establishing a circumferential fluid stream at that elevation. A fluid lance is moved along the line between the headers emitting a pulsating fluid jet perpendicular to a line of movement of the fluid lance at an elevation substantially corresponding to the level of sludge deposits. The fluid jet forces the sludge to the periphery of the tubesheet where the sludge is entrained in and carried away by the circumferential fluid stream.

9 Claims, 16 Drawing Figures

STEAM GENERATOR SLUDGE LANCING METHOD

BACKGROUND OF THE INVENTION

This invention relates to steam generators and more particularly to methods for removing sludge deposits from the tubesheets of steam generators.

A typical nuclear steam generator comprises a vertically-oriented shell, a plurality of U-shaped tubes disposed in the shell so as to form a tube bundle, a tubesheet for supporting the tubes at the ends opposite the U-like curvature, a dividing plate that cooperates with the tubesheet forming a primary fluid inlet plenum at the one end of the tube bundle and a primary fluid outlet plenum at the other end of the tube bundle, a primary fluid inlet nozzle in fluid communication with the primary fluid inlet plenum, and a primary fluid outlet nozzle in fluid communication with the primary fluid outlet plenum. The steam generator also comprises a wrapper disposed between the tube bundle and the shell to form an annular chamber adjacent the shell and a feedwater ring disposed above the U-like curvature end of the tube bundle. The primary fluid having been heated by circulation through the reactor core enters the steam generator through the primary fluid inlet nozzle. From the primary fluid inlet nozzle, the primary fluid is conducted through the primary fluid inlet plenum, through the U-tube bundle, out the primary fluid outlet plenum, through the primary fluid outlet nozzle to the remainder of the reactor coolant system. At the same time, feedwater is introduced to the steam generator through the feedwater ring. The feedwater is conducted down the annular chamber adjacent the shell until the tubesheet near the bottom of the annular chamber causes the feedwater to reverse direction passing in heat transfer relationship with the outside of the U-tubes and up through the inside of the wrapper. While the feedwater is circulating in heat transfer relationship with the tube bundle, heat is transferred from the primary fluid in the tubes to the feedwater surrounding the tubes causing a portion of the feedwater to be converted steam. The steam then rises and is circulated through typical electrical generating equipment thereby generating electricity in a manner well known in the art.

Since the primary fluid contains radioactive particles and is isolated from the feedwater only by the U-tube walls which may be constructed by Inconel, the U-tube walls form part of the primary boundary for isolating these radioactive particles. It is, therefore, important that the U-tubes be maintained defect-free so that no breaks will occur in the U-tubes. However, experience has shown that under certain circumstances, the U-tubes may develop leaks therein which allow radioactive particles to contaminate the feedwater, a highly undesirable result.

There is now thought to be at least two causes of tube leaks in steam generators. One cause of these leaks is considered to be related to the chemical environment of the feedwater side of the tubes. Analysis of the tube samples taken from operating steam generators which have experienced leaks has shown that the leaks were caused by cracks in the tubes resulting from intergranular corrosion. High caustic levels found in the vicinity of the cracks in the tube specimens taken from operating steam generators and the similarity of these cracks to failures produced by caustic under controlled laboratory conditions have identified high caustic levels as the cause of the intergranular corrosion and thus the cause of the tube cracking.

The other cause of tube leaks is thought to be tube thinning. Eddy current tests of the tubes have indicated that the thinning occurs on tubes near the tubesheet at levels corresponding to the levels of sludge that has accumulated on the tubesheet. The sludge is mainly from oxides and copper compounds along with traces of other metals that have settled out of the feedwater onto the tubesheet. The level of sludge accumulation may be inferred by eddy current testing with a low frequency signal that is sensitive to the magnetite in the sludge. The correlation between sludge levels and the tube wall thinning location strongly suggests that the sludge deposits provide a site for concentration of the phosphate solution or other corrosive agents at the tube wall that results in tube thinning.

One method for removing sludge from a steam generator is described in U.S. Pat. No. 4,079,701 entitled "Steam Generator Sludge Removal System," issued Mar. 21, 1978 in the name of Hickman et al. and assigned to the Westinghouse Electric Corporation.

In many nuclear steam generators in service today, there are 6 inch diameter hand holes in the shell of the steam generator near the tubesheet that provide access to the tubesheet for removal of the sludge deposits on the tubesheet. However, many of the steam generators in service today do not have 6 inch diameter hand holes near the tubesheet; rather, they may have 2 inch diameter inspection ports near the tubesheet which greatly limit the access that may be had to the tubesheet. This limited access greatly limits the types of apparatus and methods that may be used to remove the sludge from the tubesheets in the steam generators.

Therefore, what is needed is a method for removing sludge deposits that is capable of being used on steam generators having the 2 inch diameter inspection ports for access to the tubesheets.

SUMMARY OF THE INVENTION

A method for removing sludge that may be deposited around heat transfer tubes that extend through a cylindrical tubesheet of a steam generator comprises the placement of a fluid injection header and a fluid suction header essentially opposite each other near the elevation of the cylindrical tubesheet causing a circumferential fluid stream to be established from the injection header around the heat transfer tube bundle to the suction header. A fluid lance is moved along the line between the injection header and the suction header while emitting a pulsating fluid jet substantially perpendicular to the line of movement of the fluid lance and at an elevation substantially corresponding to the level of sludge deposits on the tubesheet. The pulsating fluid jet forces the sludge to the periphery of the cylindrical tubesheet where the sludge is entrained in and carried away by the circumferential fluid stream.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENTS

In a U-tube type steam generator, a tubesheet supports a bundle of heat transfer U-tubes. During operation, a sludge may form on the tubesheet around the U-tubes causing failure of the tubes. Failure of the tubes results in a release of radioactive particles from the primary reactor coolant into the feedwater of the steam generator. The invention, herein described, is a method for removing the sludge accumulation before it causes tube failure.

Figure 1:
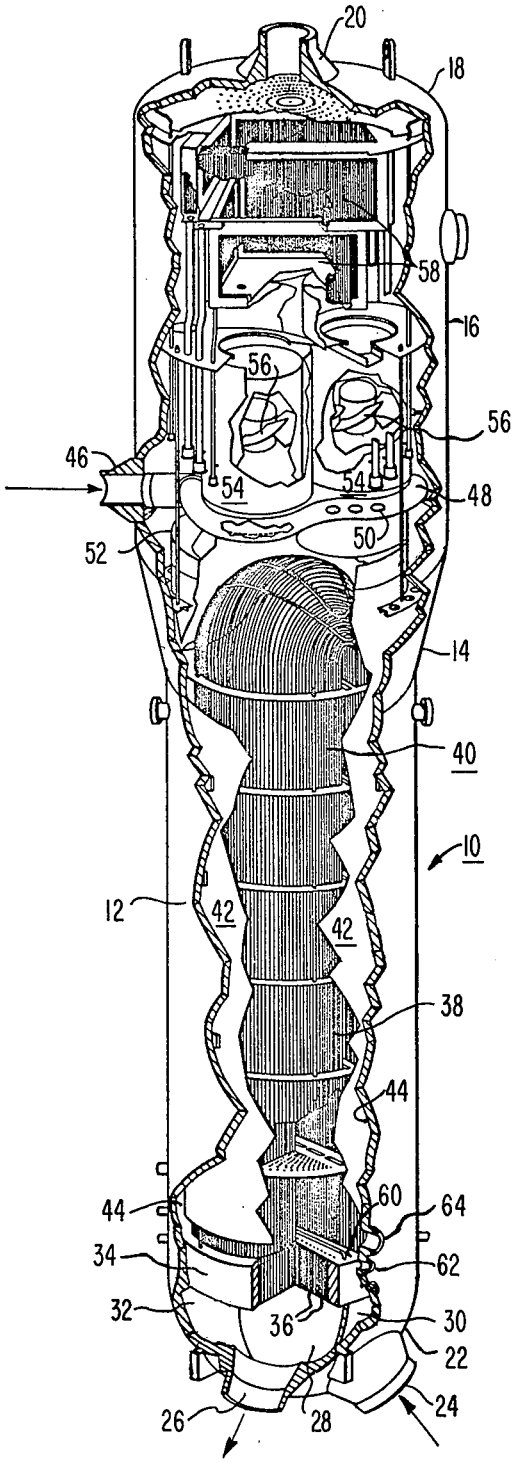
FIG. 1 is a partial cross-sectional view in elevation of a typical steam generator.

Referring to FIG. 1, a nuclear steam generator referred to generally as 10, comprises a lower shell 12 connected to a frustoconical transition shell 14 which connects lower shell 12 to an upper shell 16. A dished head 18 having a steam nozzle 20 disposed thereon encloses upper shell 16 while a substantially spherical head 22 having inlet nozzle 24 and an outlet nozzle 26 disposed thereon encloses lower shell 12. A dividing plate 28 centrally disposed in spherical head 22 divides spherical head 22 into an inlet plenum 30 and an outlet plenum 32. The inlet plenum 30 is in fluid communication with inlet nozzle 24 while outlet plenum 32 is in fluid communication with outlet nozzle 26. A tubesheet 34 having tube holes 36 therein is attached to lower shell 12 and spherical head 22 so as to isolate the portion of steam generator 10 above tubesheet 34 from the portion below tubesheet 34 in a fluid-tight manner. Tubes 38 which are heat transfer tubes shaped with a U-like curvature are disposed in tube holes 36. Tubes 38 which may number about 7,000 form a tube bundle 40. Dividing plate 28 is attached to tubesheet 34 so that inlet plenum 30 is physically divided from outlet plenum 32. Each tube 38 extends from tubesheet 34 where one end of each tube 38 is in fluid communication with inlet plenum 30, up into transition shell 14 where each tube 38 is formed in a U-like configuration, and back down to tubesheet 34 where the other end of each tube 38 is in fluid communication with outlet plenum 32. In operation, the reactor coolant having been heated from circulation through the reactor core enters steam generator 10 through inlet nozzle 24 and flows into inlet plenum 30. From inlet plenum 30, the reactor coolant flows through tubes 38 in tubesheet 34, up through the U-shaped curvature of tubes 38, down through tubes 38 into outlet plenum 32. From outlet plenum 32, the reactor coolant is circulated through the remainder of the reactor coolant system in a manner well known in the art.

Again referring to FIG. 1, tube bundle 40 is encircled by a wrapper 42 which extends from near the tubesheet 34 into the region of transition shell 14. Wrapper 42, together with lower shell 12 form an annular chamber 44. A secondary fluid or feedwater inlet nozzle 46 is disposed on upper shell 16 above tube bundle 40. A feedwater header 48 comprising three loops forming a generally cloverleaf-shaped ring is attached to feedwater inlet nozzle 46. Feedwater header 48 has a plurality of discharge ports 50 arranged in varying arrays so that a greater number of discharge ports 50 are directed toward annular chamber 44 than are directed otherwise.

During operation, feedwater enters steam generator 10 through feedwater inlet nozzle 46, flows through feedwater header 48, and out of feedwater header 48 through discharge ports 50. The greater portion of the feedwater exiting discharge ports 50 flows down annular chamber 44 until the feedwater contacts tubesheet 34. Once reaching the bottom of annular chamber 44 near tubesheet 34, the feedwater is directed inwardly around tubes 38 of tube bundle 40 where the feedwater passes in heat transfer relationship with tubes 38. The hot reactor coolant in tubes 38 transfers heat through tubes 38 to the feedwater thereby heating the feedwater. The heated feedwater then rises by natural circulation up through the tube bundle 40. In its travel around tube bundle 40, the feedwater continues to be heated until steam is produced in a manner well known in the art.

Now referring to the upper portion of FIG. 1, wrapper 42 has an upper cover or wrapper head 52 disposed thereon above tube bundle 40. Disposed on wrapper head 52 are sleeves 54 which are in fluid communication with the steam produced near tube bundle 40 and have centrifugal swirl vanes 56 disposed therein. Disposed above sleeves 54 is a moisture separator 58 which may be a chevron moisture separator. The steam that is produced near tube bundle 40 rises through sleeves 54 where centrifugal swirl vanes 56 cause some of the moisture in the steam to be removed. From sleeves 54, the steam continues to rise through moisture separator 58 where more moisture is removed therefrom. Eventually, the steam rises through steam nozzle 20 from where it is conducted through common machinery to produce electricity all in a manner well known in the art.

Referring now to the lower portion of FIG. 1, due to the curvature of tubes 38, a straight line section of tubesheet 34 is without tubes therein. This straight line section is referred to as tube lane 60. In conjunction with tube lane 60, two inspection ports 62 (only one is shown) which may be 2 inches in diameter are provided diametrically opposite each other and in colinear alignment with tube lane 60. Two additional inspection ports 62 may be located on shell 12 at 90° to tube lane 60. Inspection ports 62 allow limited access to the tubesheet 34 area. In addition, 6 inch diameter hand holes 64 may also be provided.

Experience has shown that during steam generator operation, sludge may form on tubesheet 34 around tubes 38. The sludge which usually comprises iron oxides, copper compounds, and other metals is formed from these materials settling out of the feedwater onto tubesheet 34. The sludge produces defects in the tubes 38 which allow radioactive particles in the reactor coolant contained in tubes 38 to leak out into the feedwater and steam of the steam generator, a highly undesirable result.

Figure 2:
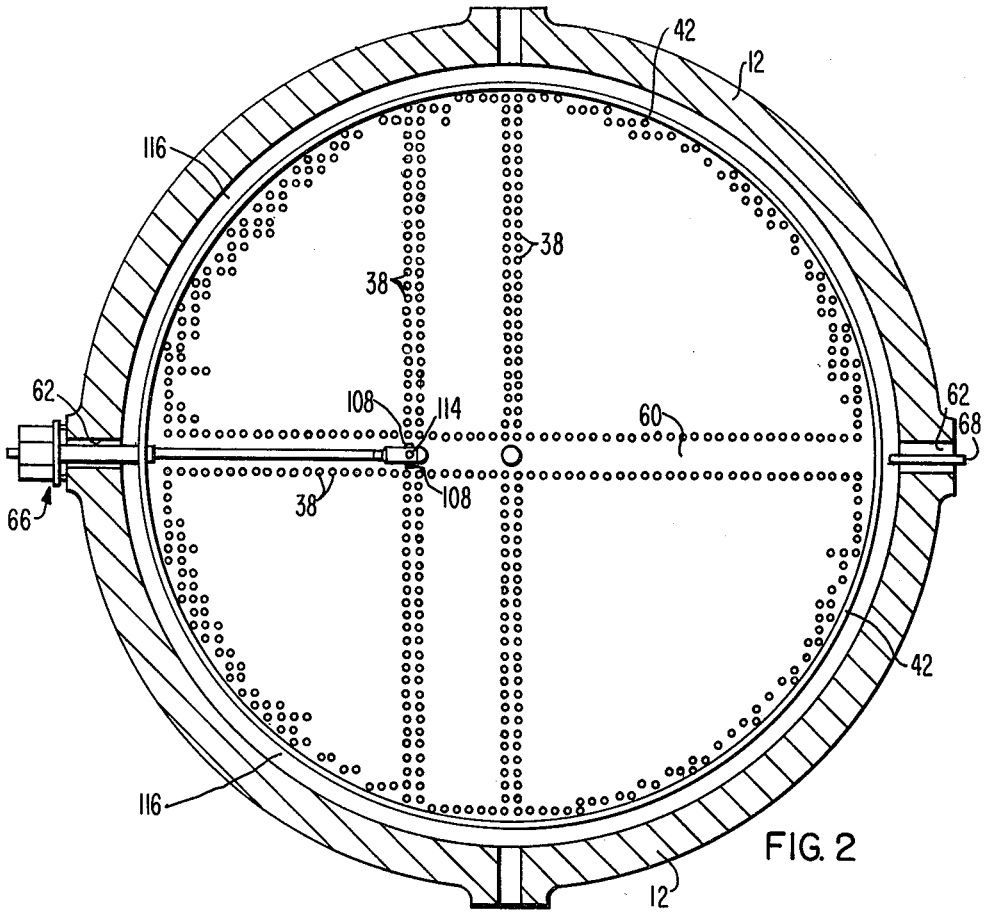
FIG. 2 is a plan view of the tubesheet.
Figure 3:
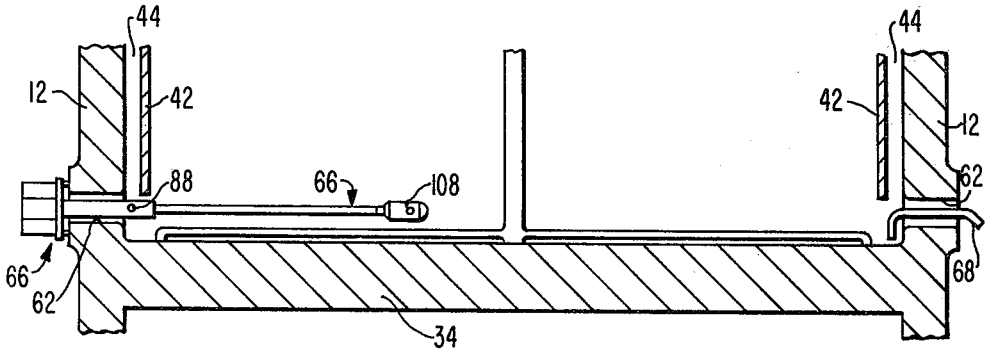
FIG. 3 is a cross-sectional view in elevation of a typical steam generator near the tubesheet.
Figure 4:
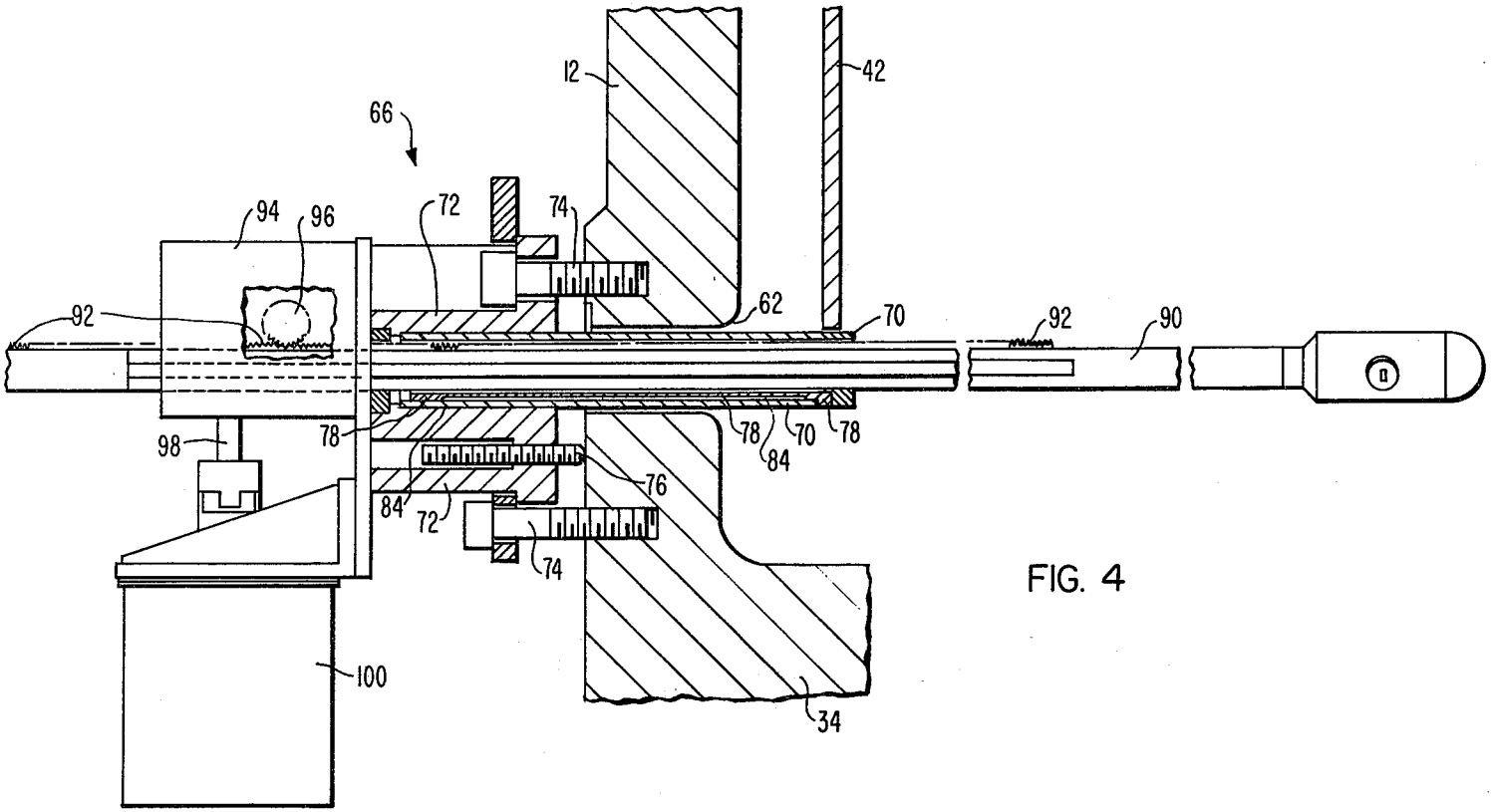
FIG. 4 is a cross-sectional view of the fluid lance extending though an inspection port in the steam generator.
Figure 5:
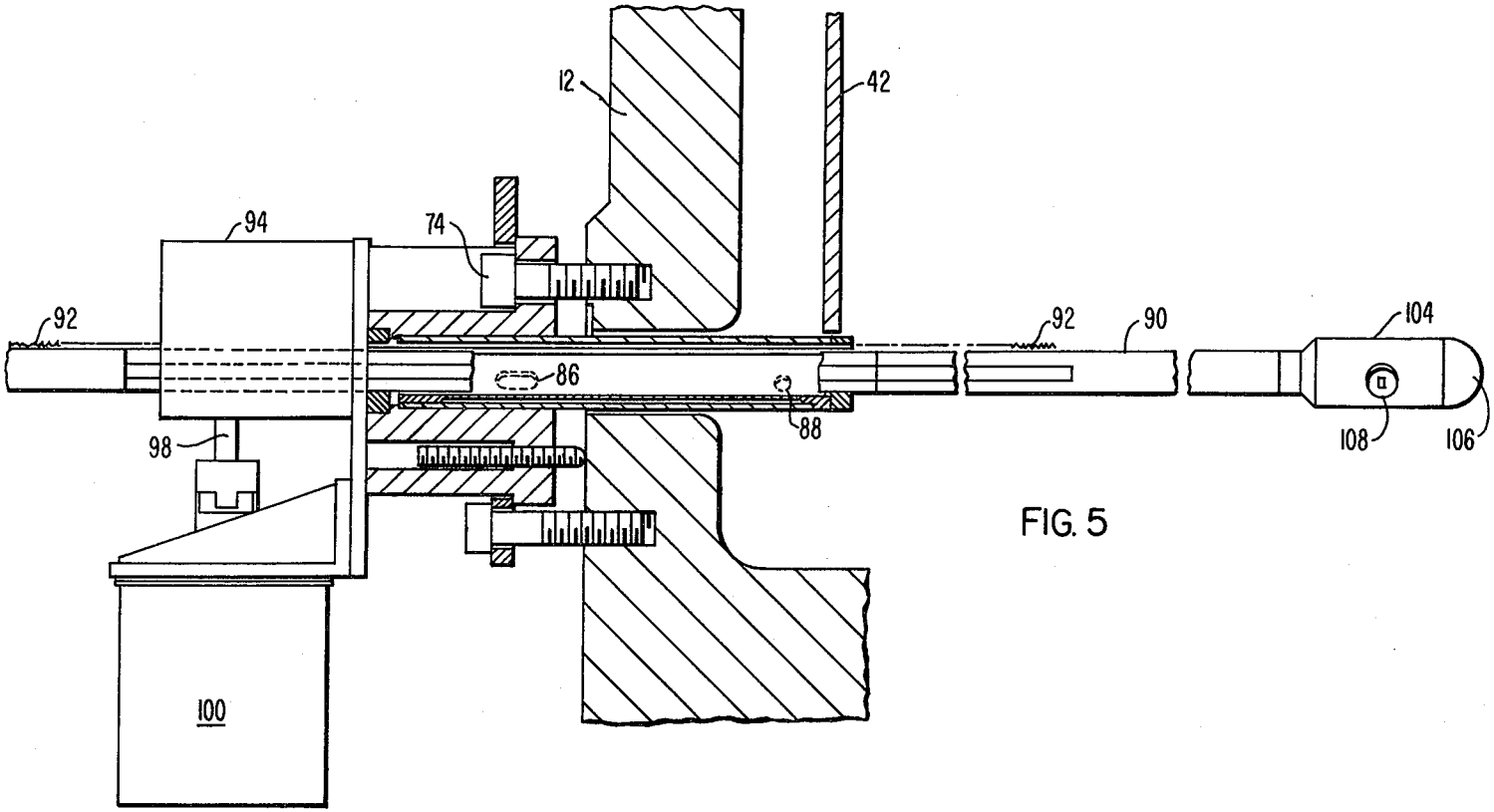
FIG. 5 is a partial cross-sectional view of the fluid lance extending through an inspection port in the steam generator.
Figure 6:
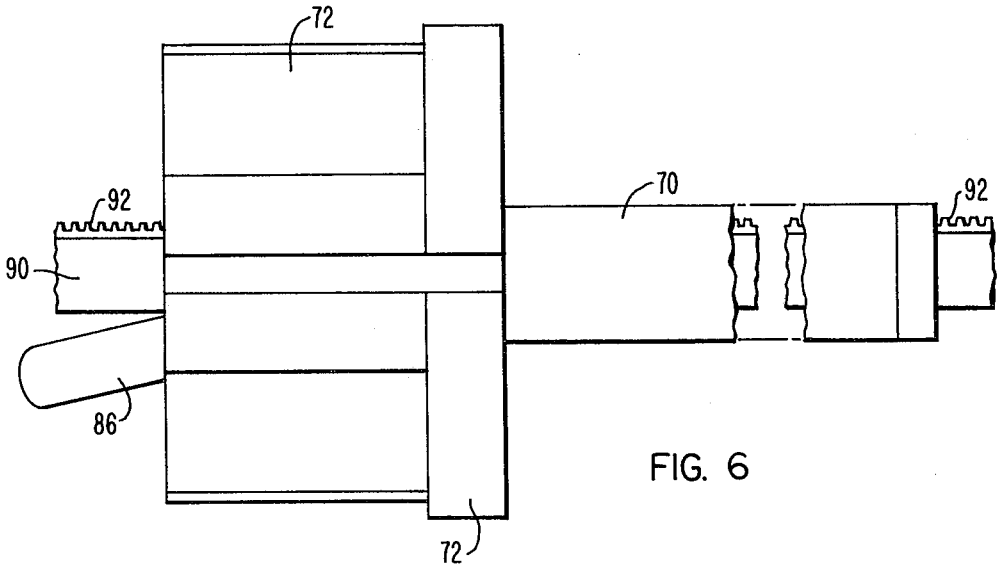
FIG. 6 is an elevational view of the outer end of the fluid lance.
Figure 7:
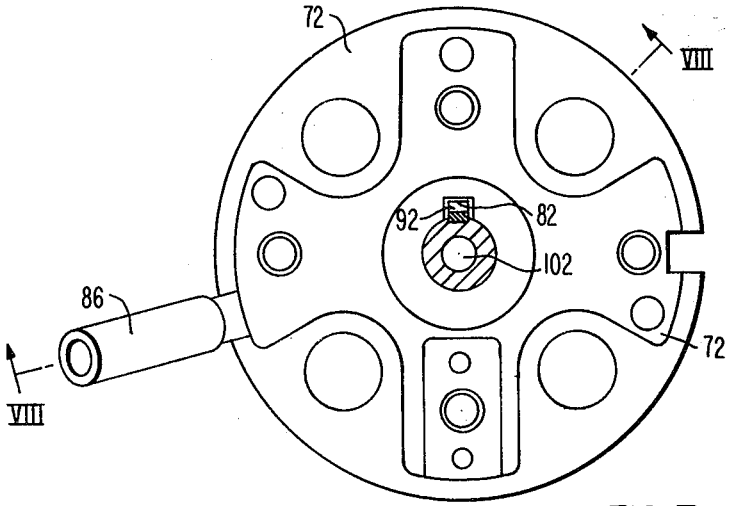
FIG. 7 is an end view of the outer end of the fluid lance.
Figure 8:
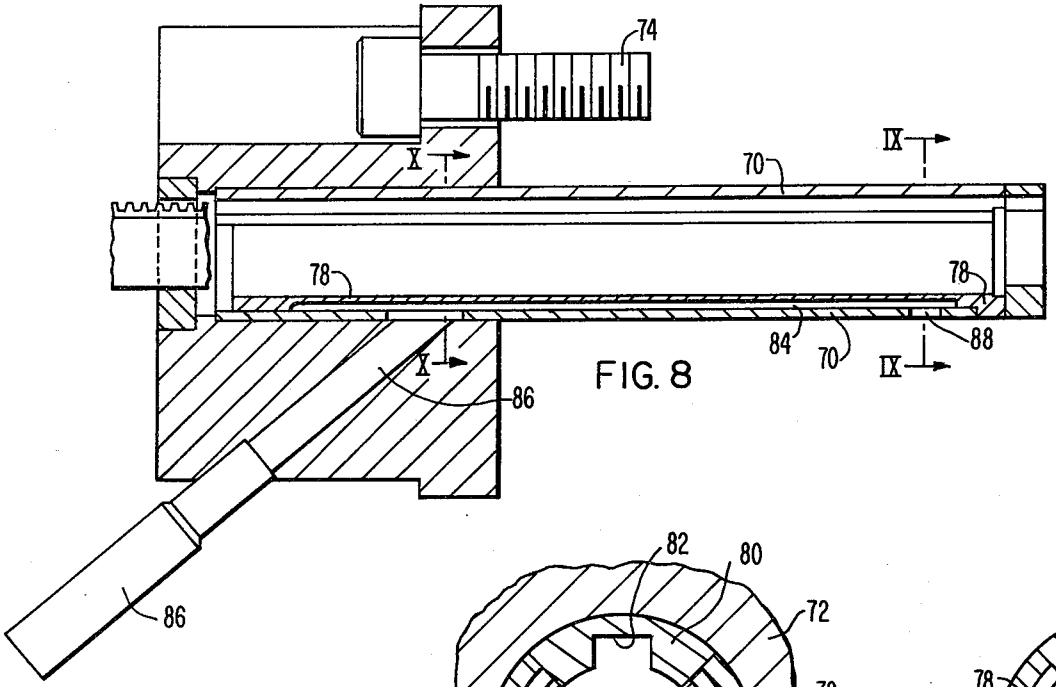
FIG. 8 is a cross-sectional view of a portion of the fluid lance.

Referring now to FIGS. 2 and 3, when the reactor is not operating such as during refueling, the steam generator may be deactivated and drained of the feedwater. Both inspection ports 62 are then opened to provide access to the interior of the steam generator. A fluid lance 66 is then placed through one of the inspection ports 62 while a suction header 68 is placed in the inspection port 62 opposite the inspection port 62 in which fluid lance 66 has been placed, as shown in FIG. 2.

Figure 9:
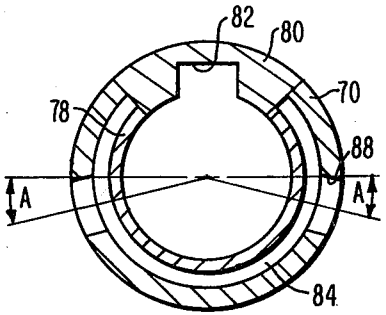
FIG. 9 is a cross-sectional view along line IX—IX of FIG. 8.
Figure 10:
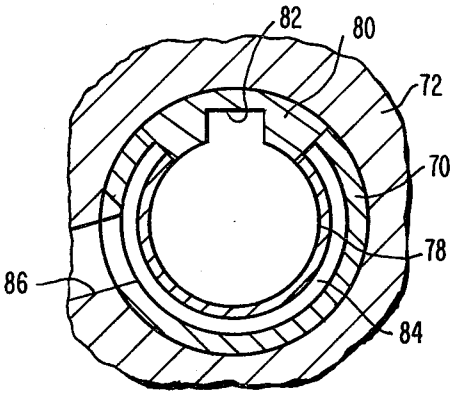
FIG. 10 is a view along line X—X of FIG. 8.
Figure 11:
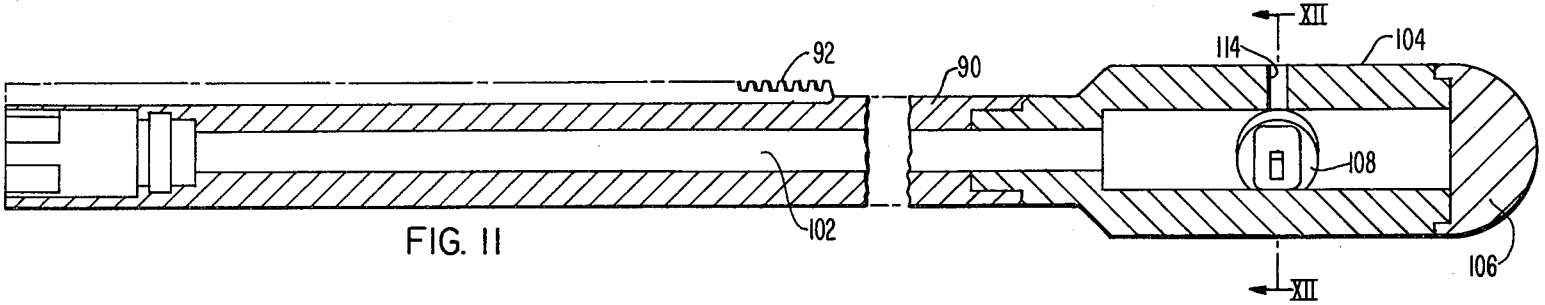
FIG. 11 is a cross-sectional view of the front end of the fluid lance.
Figure 13:
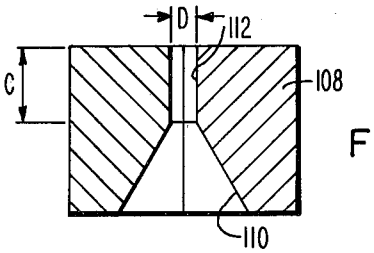
FIG. 13 is a view along line XIII—XIII of FIG. 14.
Figure 15:
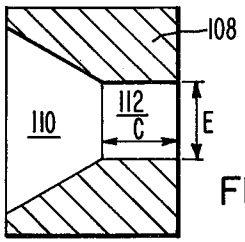
FIG. 15 is a cross-sectional view of the nozzle for the fluid lance.
Figure 14:
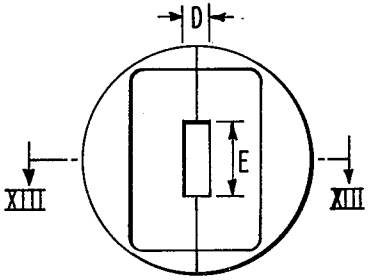
FIG. 14 is an end view of a nozzle for the fluid lance.
Figure 12:
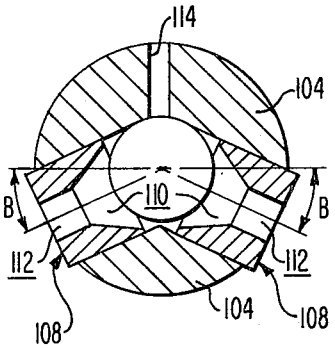
FIG. 12 is a view along line XII—XII of FIG. 11.
Figure 16:
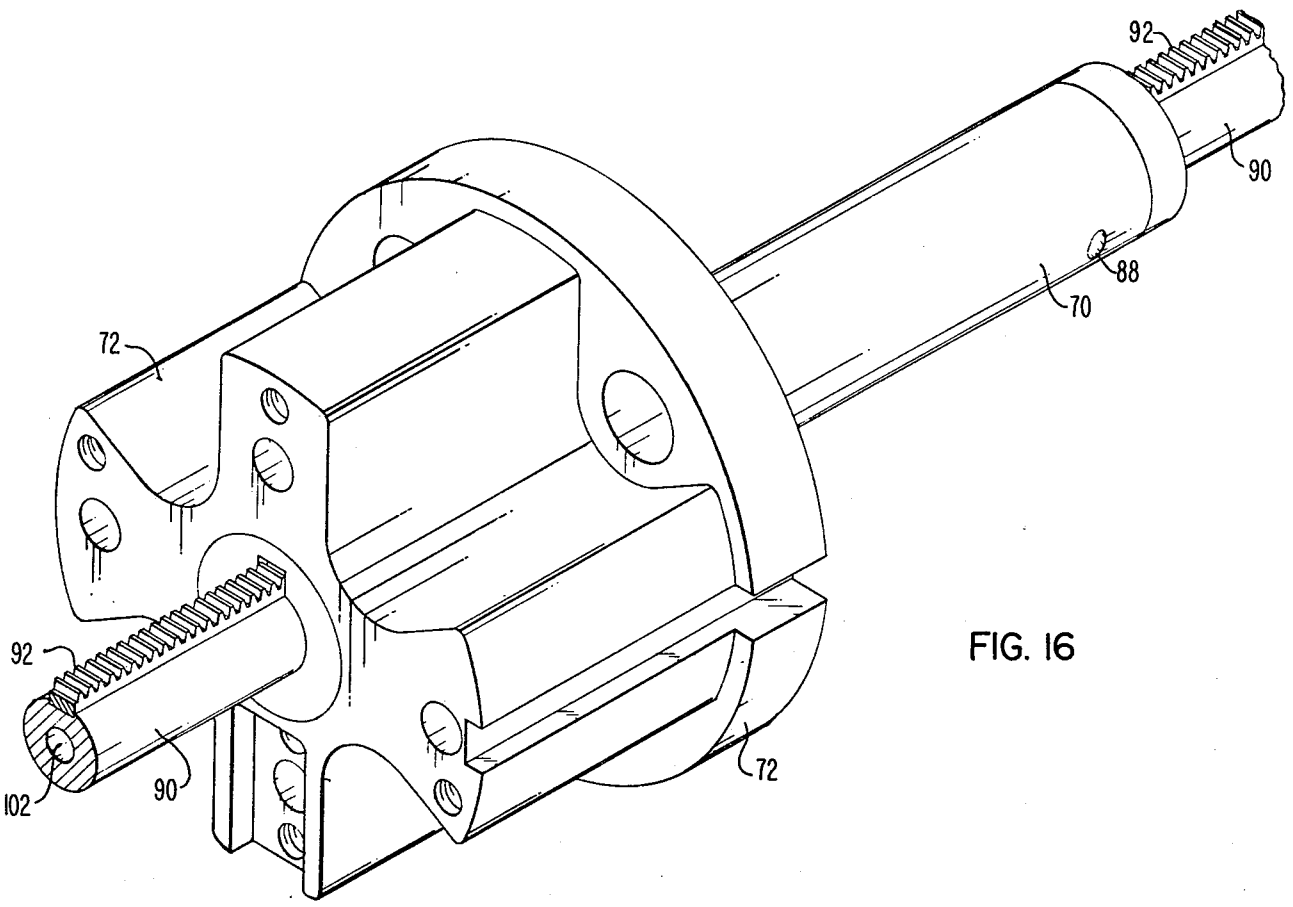
FIG. 16 is a view in perspective of the outer end of the fluid lance.

Referring now to FIGS. 4–16, fluid lance 66 comprises a first tubular member 70 which may be formed of 304 stainless steel and which is capable of being extended through the 2 inch inspection port 62. First tubular member 70 is attached to mounting plate 72 so as to support first tubular member 70. Mounting plate 72 has a plurality of holes therein so as to accommodate bolts 74. Bolts 74 are provided for attaching mounting plate 72 to shell 12 in a manner to support fluid lance 66 while it is disposed through inspection port 62. Mounting plate 72 also has holes therein for accommodating jack screws 76 which are provided for aligning mounting plate 72 with respect to shell 12 and inspection port 62. Fluid lance 66 also comprises a second tubular member 78 which is disposed within first tubular member 70. First tubular member 70 and second tubular member 78 are joined by a sectional member 80 as shown in FIGS. 9 and 10. Sectional member 80 not only joins first tubular member 70 and second tubular member 78 but also serves to support second tubular member 78 thereform. Sectional member 80 has a slot 82 therein for accommodating another member. A first annular chamber 84 is defined between first tubular member 70 and second tubular member 78 for conducting a first fluid from the outside of steam generator 10 to the inside of steam generator 10 near the tube sheet 34. The first fluid which may be water is introduced into first annular chamber 84 through first inlet 86. First tubular member 70 also has two outlet openings 88 therein near the end thereof that is disposed within steam generator 10 and as shown in FIG. 9. Outlet openings 88 are arranged such that the center line thereof are approximately 14–17 degrees from the horizontal as indicated by angle A in FIG. 9. Preferably, angle A is approximately 15° from the horizontal. Outlet openings 88 are provided for emitting the first fluid from first annular chamber 84 and onto tubesheet 34 so as to establish a peripheral flow on tubesheet 34 and around the outside of the tube bundle 40. Thus, the first fluid is introduced through first inlet 86, through first annular chamber 84 and out of outlet openings 88 onto tubesheet 34.

Fluid lance 66 also comprises a third tubular member 90 which is slidably disposed within second tubular member 78. Third tubular member 90 has a rack 92 disposed on the top portion thereof which is sized to fit through slot 82 in sectional member 80. A gear box 94 is attached to mounting plate 72 and has a first gear 96 disposed therein. First gear 96 is arranged to contact and drive rack 92. First gear 96 is also connected to drive line 98 which in turn is connected to stepping motor 100. Stepping motor 100 may be a 110 ounce-inch motor and electrically connected to common instrumentation for activating drive line 98 which in turn turns first gear 96 thus moving rack 92 in or out of shell 12 in response to operator input. The movement of rack 92 in turn causes third tubular member 90 to be moved into or out of shell 12 by sliding through second tubular member 78. It can be seen that stepping motor 100 provides a drive means by which third tubular member 90 may be moved a predetermined distance along tubesheet 34 by using controls located outside of steam generator 10.

Referring now particularly to FIGS. 11–15, third tubular member 90 which may also be formed of 304 stainless steel has a first bore 102 which may be approximately 0.375 inch in diameter that extends its entire length for conducting a second fluid therethrough. The second fluid also may be water. A head 104 is attached to first tubular member 90 at the end thereof that extends into steam generator 10. Head 104 has a cap 106 on the end thereof that seals the end of first bore 102. First bore 102 enlarges to a diameter of approximately 0.75 inches for a length of approximately 4–5 inches in head 104. Two lance nozzles 108 are disposed in head 104 at approximately the midlength of the enlarged portion of the first bore 102. Lance nozzles 108 are arranged at an angle from the horizontal as indicated by angle B in FIG. 12. Angle B may be approximately 20° to 30° from the horizontal and preferably 25°. Lance nozzles 108 are arranged such that the second fluid that is being conducted through first bore 102 is emitted from lance nozzles 108 at approximately 25° from the horizontal and onto tubesheet 34 at approximately the level of the sludge deposits on tubesheet 34.

Referring again to FIGS. 11–15, lance nozzles 108 comprise a conical chamber 110 that conducts the water from first bore 102 through outlet port 112. Outlet port 112 has a length that is indicated by length C in FIGS. 13 and 15 and which may be approximately 0.25 inch. It has been found that for the flow rates to be stated hereinafter having length C be approximately 0.25 inch provides the best results. Also, for the flow rates stated hereinafter it has been found that length D should be approximately 0.25 inch $\pm 0.005$ inch, and length E should be approximately $0.094 \pm 0.005$ inch. Since it is anticipated that the flow through lance nozzles 108 will be a pulsating type flow at a rate of approximately 15 gallons per minute through each lance nozzle 108, in order to balance the forces on head 104 and to eliminate oscillations of head 104 it is necessary to provide a top hole 114 in head 104. Top hole 114 may be a bore of 11/64ths inch in diameter that extends from first bore 102 to the outside of head 104. Top hole 114 is sized such that when the flow through each of the lance nozzles 108 is 15 gallons per minute the flow through top hole 114 will be approximately 10 gallons per minute. Under these conditions the sizing of the ports and nozzles as stated herein will provide the proper pulsation for effective sludge lancing while substantially eliminating oscillations of head 104.

From the above it can be seen that fluid lance 66 provides apparatus that is capable of injecting a first fluid through first annular chamber 84 and through outlet openings 88 so as to establish a circumferential flow on tubesheet 34 while injecting a second fluid through first bore 102 and out through lance nozzles 108 in a pulsating manner and in the direction of the sludge on tubesheet 34. In addition, a pumping mechanism (not shown) may be attached to the outside of third tubular member 90 for providing a pulsating flow of the second fluid through first bore 102. The pumping mechanism which may be chosen from those well known in the art, such as one from Aqua-Dyne Engineering, Inc., of Houston, Tex., may be chosen so as to provide approximately 35–45 gallons per minute total pulse rate having a time duration of approximately 3 to 7 seconds and with an interval between pulses of approximately 10 seconds. Preferably, the pulse flow rate of the second fluid through first bore 102 should be approximately 40 gallons per minute. Furthermore, the pumping mechanism should be chosen such that when lance nozzles 108 are located in the third of tube bundle 40 nearest outer shell 12, the pulsing time is reduced to approximately 4 to 5 seconds in duration while remaining at the 10-second interval between pulses. The flow of the second fluid through first bore 102 should be maintained at approximately 1250 to 1350 psi. At the same time a secondary pumping mechanism which may also be chosen from those well known in the art provides the flow of the first fluid through the first annular chamber 84 at about 35 to 45 gallons per minute and at approximately 65 psi. Preferably, the total peripheral flow that is established on the tubesheet should be approximately 40 gallons per minute. The system is established so that there are 4 pulses between each row of tubes 38 which should be sufficient to dislodge the sludge on the tubesheet between the tubes 38 and carry the sludge to the circumference of the tubesheet 34 where it will become entrained in the peripheral flow and carried to suction header 68 where it will be removed from steam generator 10.

OPERATION

First, the steam generator 10 is deactivated and drained of its water. Next, the covers are removed from inspection ports 62 and fluid lance 66 is bolted to the outside of one of inspection ports 62 in alignment with tube lane 60 and suction header 68 is placed through the other inspection port 62 in alignment with tube lane 60, as shown in FIG. 2. When bolted into place, fluid lance 66 is arranged such that outlet openings 88 are at approximately 15° from the horizontal and directed toward the circumferential peripheral lane 116 while lance nozzles 108 are directed at approximately 25° from the horizontal and between the first row of tubes 38. When in this position, the secondary pumping mechanism is activated which causes the first fluid to be pumped through first inlet 86 and through first annular chamber 84 where it exits through outlet openings 88, thereby establishing a peripheral flow through peripheral lane 116 which is along the outside circumference of the tube bundle 40. The peripheral flow is established such that the flow through each outlet opening 88 is approximately between 17 to 23 gallons per minute. Preferably, the flow through each outlet opening 88 is approximately 20 gallons per minute. Thus a stream of approximately 20 gallons per minute is established from each outlet opening 88, around the outside of the tube bundle 40, and to the suction header 68. It can be seen that suction header 68 should be sized to remove approximately 60 gallons per minute. Once the peripheral flow has been established, the pumping system for the second fluid is activated which causes the second fluid to flow through first bore 102 at a pulse rate of approximately between 35 to 45 gallons per minute and preferably at approximately 40 gallons per minute. The pressure of the fluid flowing through bore 102 should be between approximately 1250 to 1350 psi. Next, the pulsing is initiated that causes a pulse having a rate of approximately 15 gallons per minute to be emitted from each lance nozzle 108 while a pulse through top hole 114 is emitted at a pulse rate of approximately 10 gallons per minute. While head 104 is less than one third of the distance from the circumference to the middle of tube lane 60, the pulse length is approximately 4 to 5 seconds while the interval between pulses is timed to be approximately 10 seconds. This timing and flow rates have been found to be quite effective in dislodging the sludge from the tubesheet 34. After at least 4 pulses have been emitted from each lance nozzle 108, third tubular member 90 is advanced along tube lane 60 and toward the center of the steam generator 10 by means of rack 92 and first gear 96 as previously described. Third tubular member 90 is advanced in this manner until lance nozzles 108 are aligned between the next row of tubes 38. At this point, the process is repeated wherein 4 pulses are emitted from each lance nozzle 108 thereby dislodging the sludge from tubesheet 34 and carrying the sludge to the peripheral flow at the circumference of tubesheet 34 where the peripheral flow entrains the sludge and carries it to suction header 68 for removal from the steam generator. Third tubular member 90 is continued to be advanced toward the center of the steam generator 10 and along tube lane 60 until head 104 is more than approximately one third the distance from the circumference to the center of the steam generator. At this point, the pulse length is increased to approximately 5 to 6 seconds in duration while the interval between pulses remains at approximately 10 seconds. Once again, 4 pulses are emitted before the lance is advanced. It should be noted that in the outermost rows of the tube bundle 40 the pulse time is somewhat shorter because the lance nozzles 108 are closer to the peripheral flow. With the lance nozzles 108 being closer to the peripheral flow, a shorter pulse time is necessary so that a reduced volume of fluid is emitted from the lance nozzles 108 to thereby prevent disruption of the peripheral flow. It has been found that when the pulsing time is too long, the peripheral flow is disrupted and the sludge is not carried away with the peripheral flow. Therefore, it is important to select the proper pulse timing and interval between pulses so as to match the proper volumetric flow rates of fluid being emitted from lance 66 in order to perform the sludge removal process properly. When head 104 reaches the center of tube lane 60 which corresponds to the center of steam generator 10, one-half of the steam generator 10 will have been lanced. The flows through fluid lance 66 are then terminated, and fluid lance 66 is unbolted from shell 12. At the same time, suction header 68 is removed from its inspection port 62 and arranged in inspection port 62 from which the fluid lance 66 has just been removed, fluid lance 66 is bolted around inspection port 62 from which suction header 68 has just been removed. In this manner, the location of fluid lance 66 and suction header 68 are reversed. The above-described process is then performed on the second half of the steam generator 10. When the second half of the process has been completed, the entire process is performed two additional times which results in three entire sweeps of tubesheet 34. Upon completion of three entire sweeps of tubesheet 34, approximately 85% of the sludge deposited on tubesheet 34 can be removed.

Of course, since steam generators exist that have various types and locations of hand holes and access ports, variations in the above-described process may be made to utilize such access ports. Therefore, it can be seen that the invention provides a method for removing sludge deposits from the tubesheet of a steam generator.

We claim as our invention:

1. A method for removing sludge deposits from a steam generator comprising the steps of:

inserting fluid injection apparatus into said steam generator near the base thereof;

placing fluid suction apparatus in said steam generator in a position substantially opposite said fluid injection apparatus;

positioning a movable fluid lance in said steam generator near said base;

supplying a first fluid to said fluid injection apparatus at between approximately 35 to 45 gpm and establishing a peripheral fluid stream from said fluid injection apparatus to said fluid suction apparatus;

supplying a second fluid to said fluid lance and causing said fluid lance to emit pulses of fluid with each pulse being approximately 14–16 gpm and having a pulse length of approximately 3–7 seconds and simultaneously discharging the same along said base dislodging said sludge deposit while forming a sludge-fluid mixture that becomes entrained in said peripheral fluid stream;

moving said fluid lance in a linear direction along said base; and discharging said mixture into said fluid suction apparatus.

2. The method according to claim 1 wherein the interval between pulses is approximately 10 seconds.

3. The method according to claim 2 wherein said pulse length is approximately 5–6 seconds in duration when said fluid lance is located at least one-third the distance from the circumference to the center of said steam generator.

4. The method according to claim 3 wherein the pulse length is approximately 4–5 seconds in duration when the fluid lance is located in the outer one-third of said steam generator.

5. The method according to claim 4 wherein said first fluid is supplied to said fluid injection apparatus at approximately 40 gpm and at approximately 65 psi.

6. The method according to claim 5 wherein said second fluid is supplied to said fluid lance between approximately 1250 psi to 1350 psi.

7. The method according to claim 6 wherein said second fluid is supplied to said fluid lance in pulses having a rate of 40 gpm.

8. The method according to claim 7 wherein said method further comprises:

moving said fluid lance from near the outside of said steam generator to near the center of said steam generator;

reversing the position of said fluid injection apparatus, said fluid lance, and said fluid suction apparatus; and moving said fluid lance from near the outside of said steam generator to near the center of said steam generator.

9. The method according to claim 8 wherein said method further comprises completing at least three sweeps of the steam generator with said fluid lance.

* * * * *